United States Patent [19]

Schumann

[11] Patent Number: 4,557,175

[45] Date of Patent: Dec. 10, 1985

[54] LIGHT-RESPONSIVE MUSICAL INSTRUMENT

[76] Inventor: Martin Schumann, 4526-1st Ave. N., St. Petersburg, Fla. 33713

[21] Appl. No.: 592,226

[22] Filed: Mar. 22, 1984

[51] Int. Cl.[4] ..... G10D 17/00

[52] U.S. Cl. ..... 84/330; 446/14; 446/213; 446/216

[58] Field of Search ..... 84/1, 83, 330–331; 116/1, 3, 137 R; 250/526; 446/14, 213, 216

[56] References Cited

U.S. PATENT DOCUMENTS 164,458 6/1875 Kastner ..... 84/330
500,433 6/1893 Schubert ..... 84/330

FOREIGN PATENT DOCUMENTS 1091 of 1873 United Kingdom ..... 84/330
3879 of 1874 United Kingdom ..... 84/330

OTHER PUBLICATIONS

Frank S. Crawford, "Singing Corrugated Pipes", Apr. 1974, vol. 42, AJP (American Journal of Physics) (?) p. 279.

*Primary Examiner*—Lawrence R. Franklin
*Attorney, Agent, or Firm*—Ronald E. Smith

[57] ABSTRACT

A musical instrument that produces whistle-type tones responsive to the impingement of sunlight or other source of electromagnetic radiation upon one or more radiation-absorbent porous-to-air, generally disc-shaped generator member or members disposed interiorly and in the lower half of a vertically oriented transparent or partially transparent tube with angled open ends. The generator member or members may be in the form of a wire mesh or gauze. In a preferred embodiment, Fresnel lenses are employed to focus sunlight on the generators contained within a plurality of tubes of differing lengths that are grouped together to form a musical instrument suitable for display in public places for the entertainment and scientific edification of the public.

16 Claims, 2 Drawing Figures

LIGHT-RESPONSIVE MUSICAL INSTRUMENT

BACKGROUND OF THE INVENTION

1. Field of the Invention

This invention relates, generally, to sound-producing devices, and more particularly relates to such devices activated by electromagnetic radiation.

2. Description of the Prior Art

Singing tubes, as they are known, have been studied in scientific laboratories engaged in wave motion and sound research. The application of heat to a metal gauze member placed in the lower half of a vertically oriented tube with open ends causes the air contained within the tube to resonate at a characteristic fundamental frequency dictated by the length of the tube, producing sound. The laboratory tube is normally formed of brass or other opaque material, has ends which terminate in a plane normal to the vertical axis of the tube, and contains a single gauze member. The source of heat is normally a propane flame formed by a burner means.

It is believed that air currents rise from the gauze member when it is heated. In view of the porosity of the gauze member, air below it also rises, is heated periodically as it passes through such hot gauze member, and exits the tube through the top thereof in a continuous stream. Thus, a stream of air is established that enters the bottom of the tube at ambient temperatures and exits the tube at its top in a heated condition. If the heated gauze member were impervious to air, the upwardly directed air flow obviously could not be established.

The "singing tube", as it is known to acoustic researchers, has heretofore been studied as a single unit, there being no known musical instruments that have been formed by grouping a plurality of the tubes in a single location. Nor have the metal gauze members, or generators, been heated by focused sunlight or designed to be heated by focused sunlight through transparent cylindrical walls. Nor has a single tube been fitted with a plurality of generator members, enabling a single tube to resonate at more than one characteristic frequency. Nor has a single tube been provided with ends cut on an angle to the vertical axis of the tube, thereby rendering the sound generating capacity of the tube sensitive to, or dependent upon, the direction of ambient air currents.

SUMMARY OF THE INVENTION

The present invention provides a transparent, substantially cylindrical in configuration tube member of predetermined length and diameter having one or two disc-shaped wire mesh heat generators disposed interiorly and in the lower half thereof with their peripheral edges fixedly secured to the inner sidewalls of such tube. The primary (fundamental tone) generator being located approximately one-third of the length of the tube from the lower end of same, and the secondary (octave tone) generator being located approximately one-sixth of the length of the tube from the lower end of same. In practice, a plurality of said tubular members are grouped adjacent to one another and held by a support means so that their respective generator areas are in close proximity to one another, in combination with a lens system or reflector system for focusing sunlight or other suitable source of electromagnetic radiation upon said heat generators in sufficient concentration to heat the same sufficiently to initiate and maintain an upwardly directed air flow through the tube generally and specifically through the interstitial spaces defined by the mesh resulting in periodic resonance of the air column contained by the tubular structure and the consequent production of sound. In a first embodiment, the lens system rotates in opposition to the motion of the earth, so that the amount of sunlight focused on the generators is substantially constant throughout the day. A second embodiment includes a non-tracking or fixed lens or lenses so that different tones are produced as the sun traverses its apparent path across the sky, and the focus of said lens or lenses moves from tube to tube, and from generator to generator within a single tube.

It is an object of this invention to provide a musical instrument having few moving parts, requiring little or no maintenance, and being suitable for display in public places.

Another object is to advance the art of singing tubes by disclosing a transparent or partially transparent tube and a lens system that harnesses energy from the sun or other radiant energy source to activate the heat generator or generators within the tube.

A further object is to advance the art of singing tubes by disclosing a plurality of generator members within a single tube, providing a plurality of discrete tones of differing pitch from a single tube.

Still another object is to advance the art of singing tubes by disclosing a tube the ends of which are terminated in planes that intersect the vertical axis of the tube at an angle other than ninety degrees, both planes being parallel to each other, thereby rendering a tube the sound production capacity of which is sensitive to ambient air currents, being enhanced when wind direction is so disposed as to enter the lower end, and being impeded when wind direction is so disposed as to enter the upper end.

The invention accordingly comprises the combination of elements, features of construction, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
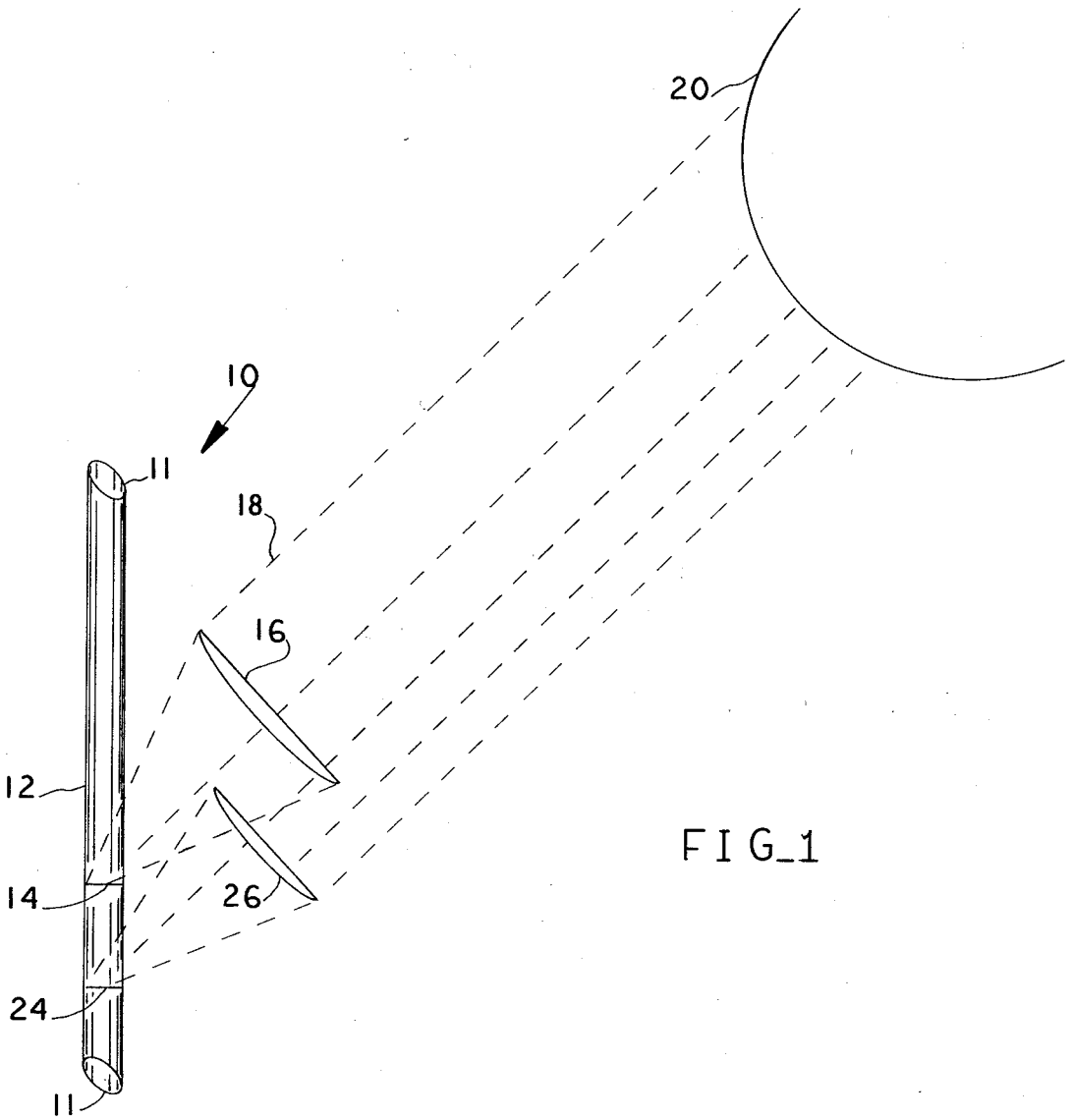
FIG. 1 is a diagrammatic representation that includes a side elevational view of the novel transparent singing tube of this invention.

Referring now to FIG. 1, it will there be seen that the inventive assembly is indicated by the reference numeral 10 as a whole. A cylindrical tube 12 formed of an acrylic plastic, glass, or other suitable transparent material is shown with its vertical axis of symmetry disposed orthogonal to the ground or other support surface, not shown. The vertical disposition of tube 12 is not critical, and angles of inclination of up to about forty five (45) degrees are acceptable. The angle of termination of the ends 11 of tube 12 are also not critical, angles of five (5) to forty five (45) being acceptable.

A heat generating means 14 is disposed within the lower half of tube 12, preferably spaced from the lowermost end thereof by a distance approximately equal to one-quarter (¼) to one-third (⅓) of the length of tube 12. Another heat generating means 24 is disposed within the lower one-sixth (1/6) of tube 12. Means 14 and 24 are fixedly secured to the inner cylindrical sidewalls of the tube by suitable means and hence held against axial displacement.

A converging lens member 16 of Fresnel type or of conventional construction is spaced from the tube and specifically positioned to focus light 18 from the sun 20 onto the generator means 14 and to thereby heat the same.

Another converging lens member 26 of Fresnel type or of conventional construction is spaced from the tube and specifically positioned to focus light 18 from the sun 20 onto the generator means 24 to thereby heat the same.

The generator means 14 and 24 may be provided in the form of an open mesh, metallic, disc-shaped member. Another material found to work well as a heat-generating member is a copper ribbon wadding. When material from a pad of this type is employed, the generating means may have a thickness of about one-fourth inch (¼"). More specifically, the "wadding" is a metallic ribbon-like material that is interwoven in a substantially random pattern. The thickness of the wadding should be about one-fourth its diameter and it should be porous to air but substantially impervious to light. The porosity of such material provides a plurality of paths for air entering the bottom of the tube to pass through en route to the tube exit at the uppermost end thereof. Material of such type also transfers heat well so that heat generated by concentrated sunlight will be evenly distributed throughout the pad, which distribution prolongs the useful life of the generator member and augments the efficiency of the sound-generating capability of the tube.

Figure 2:
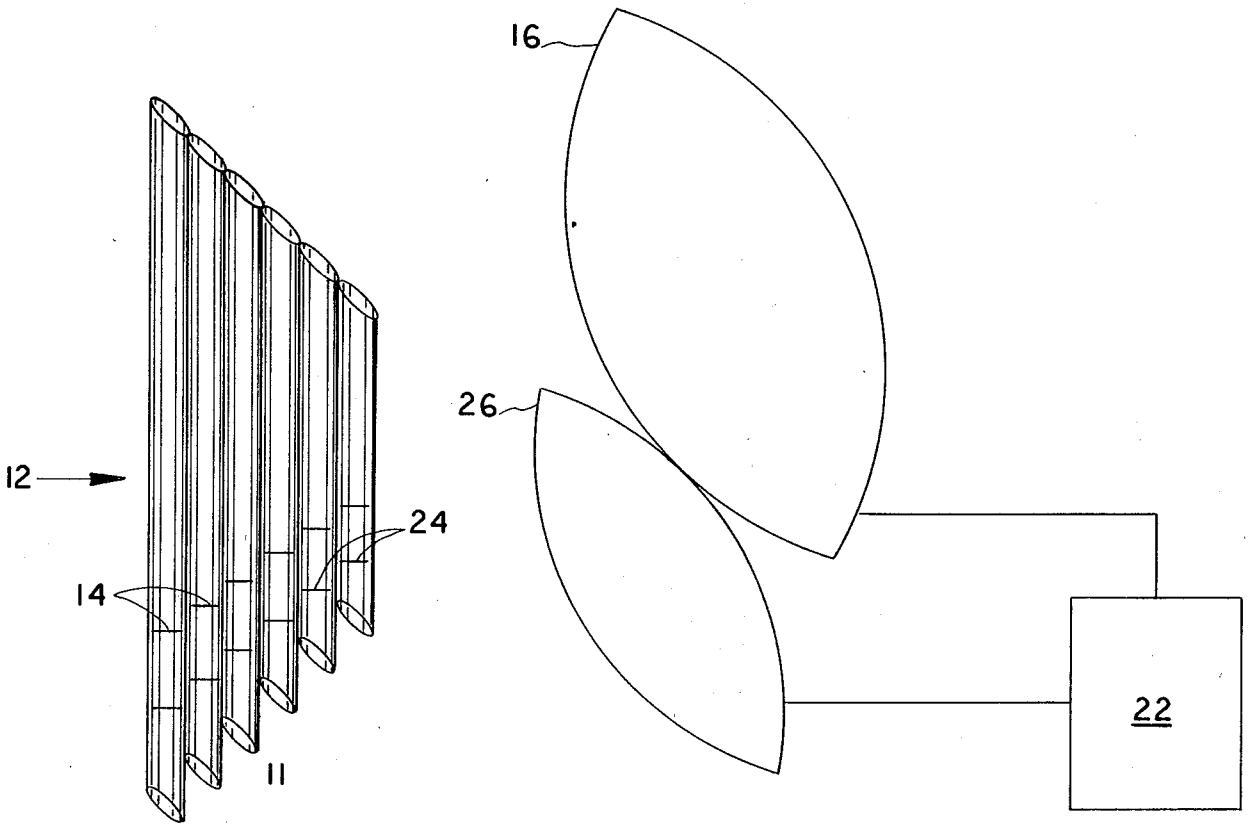
FIG. 2 is a perspective view showing an array of the tubes that collectively form a musical instrument.

Making reference now to FIG. 2, a plurality of the tubes, collectively designated 12, comprise a musical instrument of "a" type heretofore unknown. In this FIG., a tracking means 22 is shown for maintaining the same amount of the sun's rays on the generating means throughout the day. This would allow the tubes to "sing" at their highest decibel level independent of the time of day. In the preferred embodiment, however, tracking means 22 is not provided, and the tubes produce differing sounds as the earth rotates. This embodiment would involve less expense to public agencies desiring to erect the musical instrument disclosed herein as the cost of tracking means 22 could be high.

Although sunlight has been described as the source of heat to excite generating means 14 and 24, it should be noted, of course, that visible light occupies a very small range of the electromagnetic spectrum, and the energy of radiation of different wavelengths could also be harnessed to heat generating members 14 and 24. Microwave radiation, for example, could be employed in lieu of sunlight. The method of light convergence may also be practiced with reflecting or refracting elements of suitable configuration.

The tubes 12 can be provided in many differing lengths, diameters and configurations as well.

It is further worthy of note that adjacent tubes may interact with one another in accordance with resonance principles. For example, the generator of a given tube may not have sunlight focused on it at a given time, but it may resonate with an adjacent tube that is excited, and thereby emit musical tones. Moreover, harmonics are generated by the lower generator 24, in additon to the fundamental frequencies, and such multiple frequencies provide an abundance of musical sounds. When displayed in a public place, a musical instrument of the type described herein would not only provide a low cost, aesthetically pleasing structure, but would also serve to increase the public's knowledge of the sound-producing properties of heated air columns.

It will thus be seen that the objects set forth above, and those made apparent by the foregoing description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. A musical instrument, comprising, a transparent tube member of predetermined dimension and configuration, said tube member disposed in generally upstanding disposition, a heat generating member disposed interiorly of said tube member, in the lower half thereof, said heat generating member having its peripheral edges fixedly secured to the inner sidewalls of said tube member, said heat generating member being formed of an open mesh material capable of absorbing radiant energy, a radiant energy source external to said tube member for heating said heat generating member, and a focusing means for concentrating the heat of said radiant energy source upon said heat generating member so that musical sound is emitted by said tube member in response to heating of said heat generating member by said radiant energy source.

2. The musical instrument of claim 1, further comprising, in combination, a plurality of transparent tube members of predetermined dimension and configuration, said tube members collectively arrayed in a group so that each tube member is contiguous to at least one other tube member, each of said tube members disposed in a generally upstanding disposition, a heat generating member disposed interiorly of each of said tube members, in the respective lower halves thereof, there being as many heat generating members as there are tube members, each of said heat generating members being generally disc-shaped and having their respective peripheral edges fixedly secured to the inner sidewalls of their associated tube members, each of said heat generating members being formed of an open mesh material capable of absorbing radiant energy, a radiant energy source external of said tube members for heating each of said heat generating members, and a focusing means for concentrating the heat of said radiant energy source upon said heat generating members so that musical sound is emitted by said tube members in response to heating of said heat generating members by said radiant energy source.

3. The musical instrument of claim 1, wherein said heat generating member is formed of a metallic ribbon-like material that is interwoven in a substantially random pattern, said heat generating member having a thickness equal to about one-fourth its diameter and said member being porous to air.

4. The musical instrument of claim 1, wherein said radiant energy source is the sun.

5. The musical instrument of claim 4, wherein a sun-tracking means is provided to maintain the amount of sunlight focused upon said heat generating member at a substantially constant level throughout the day.

6. The musical instrument of claim 1, wherein said focusing means is a light reflecting mirror member or a light refracting lens member.

7. A musical instrument, comprising, a transparent tube member of predetermined dimension and configuration, said tube member disposed in generally upstanding disposition, a first heat generating member disposed interiorly of and in the lower half of said tube, a second heat generating member disposed interiorly of said tube member and positioned below said first heat generating member, said first and second heat generating members being fixedly secured to the inner sidewalls of said tube member, a source of radiant energy external to said tube member, said first and second heat generating members formed of an open mesh material capable of absorbing radiant energy from said radiant energy source, and a focusing means for concentrating the radiant energy from said radiant energy source on said heat generating members so that musical sounds of different pitch are emitted by said tube member.

8. The musical instrument of claim 7, wherein said radiant energy source is the sun.

9. The musical instrument of claim 8, wherein a sun-tracking means is provided to maintain the amount of sunlight focused upon said heat generating members at a substantially constant level throughout the day.

10. The musical instrument of claim 7, wherein said focusing means are light reflecting mirror members or light refracting lens members.

11. The musical instrument of claim 7, wherein said heat generating members are formed of a metallic ribbon-like material that is interwoven in a substantially random pattern, said members each having a thickness equal to about one-fourth their respective diameters and said members being porous to air and substantially impervious to sunlight.

12. A musical instrument, comprising, a transparent tube member of predetermined dimension and configuration, said tube member disposed in generally upstanding disposition, at least one heat generating member disposed interiorly of said tube member and fixedly secured to the inner sidewalls thereof, a source of radiant energy external to said tube member, said at least one heat generating member formed of an open mesh material capable of absorbing radiant energy from said source, a focusing means for concentrating said radiant energy from said source on said at least one heat generating member, said tube member having opposed ends, at least one of said tube member ends terminating in a plane not perpendicular to the vertical axis of said tube member to thereby render the sound production capability of said tube member sensitive to the direction of ambient air currents.

13. The musical instrument of claim 12, wherein said radiant energy source is the sun.

14. The musical instrument of claim 13, wherein a sun-tracking means is provided to maintain the amount of sunlight focused upon said at least one generating member at a substantially constant level throughout the day.

15. The musical instrument of claim 12, wherein said focusing means is at least one light reflecting mirror member or at least one light refracting lens member, there being as many mirror members or lens members as there are heat generating members.

16. The musical instrument of claim 12, wherein said at least one heat generating member is formed of a metallic ribbon-like material that is interwoven in a substantially random pattern, said at least one member having a thickness equal to about one-fourth its diameter and said member being porous to air and substantially impervious to sunlight.

* * * * *